US010493715B2

(12) United States Patent
Totani

(10) Patent No.: US 10,493,715 B2
(45) Date of Patent: Dec. 3, 2019

(54) APPARATUS AND METHOD FOR MAKING PLASTIC BAGS

(71) Applicant: Totani Corporation, Kyoto (JP)

(72) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 233 days.

(21) Appl. No.: 15/562,037

(22) PCT Filed: Jun. 9, 2016

(86) PCT No.: PCT/JP2016/067252
§ 371 (c)(1),
(2) Date: Sep. 27, 2017

(87) PCT Pub. No.: WO2016/199863
PCT Pub. Date: Dec. 15, 2016

(65) Prior Publication Data

US 2018/0104923 A1 Apr. 19, 2018

(30) Foreign Application Priority Data

Jun. 11, 2015 (JP) ..... 2015-118613

(51) Int. Cl.
*B31B 50/18* (2017.01)
*B31B 50/10* (2017.01)

(52) U.S. Cl.
CPC ..... *B31B 50/18* (2017.08); *B31B 50/10* (2017.08)

(58) Field of Classification Search
CPC ..... B31B 50/10; B31B 50/18; B31B 70/00; B31B 70/14; B31B 70/16; B31B 70/26;
(Continued)

(56) References Cited

U.S. PATENT DOCUMENTS 3,473,723 A * 10/1969 Bolling, Jr. ..... B65D 5/0227 229/184
4,505,699 A * 3/1985 Totani ..... B31B 70/00 493/196

(Continued)

FOREIGN PATENT DOCUMENTS

EP 2279857 2/2011
EP 2279857 A1 * 2/2011 ..... B31B 70/18

(Continued)

OTHER PUBLICATIONS

European Search Report dated Dec. 14, 2018 in corresponding European patent application No. 16807569.5.

(Continued)

*Primary Examiner* — Hemant Desai
*Assistant Examiner* — Jacob A Smith
(74) *Attorney, Agent, or Firm* — Kirschstein, Israel, Schiffmiller & Pieroni, P.C.

(57) ABSTRACT

In an apparatus and method for successively making plastic bags, webs of first and second panel materials are superposed and fed longitudinally. A plastic film is slit to form longitudinal slit lines so as to be divided into the web of the first panel material and a plurality of webs of a bottom gusset material before the webs of the first and second panel materials are superposed. Then, the webs of the bottom gusset material are guided and supplied to the webs of the first or second panel material by bottom gusset material guide devices. The bottom gusset material is not supplied from another supply roll, and a pattern discrepancy is not caused.

4 Claims, 11 Drawing Sheets

(58) Field of Classification Search
CPC ..... B31B 70/36; B31B 70/18; B31B 70/266; B31B 2155/00; B31B 2155/001; B31B 2160/10; B31B 2160/20
USPC ..... 493/186, 189, 194, 199, 203, 210, 218, 493/219, 223, 231, 264
See application file for complete search history.

(56) References Cited

U.S. PATENT DOCUMENTS

| | | | | |
|---|---|---|---|---|
| 4,997,504 | A * | 3/1991 | Wood | B29C 66/71 156/204 |
| 7,510,515 | B2 * | 3/2009 | Ichikawa | B65D 33/02 493/202 |
| 7,775,957 | B2 * | 8/2010 | Totani | B65D 31/10 493/189 |
| 9,050,770 | B1 * | 6/2015 | Russell | B31B 70/60 |
| 2001/0023571 | A1 * | 9/2001 | Bois Henri | B65D 31/10 53/410 |
| 2004/0245270 | A1 * | 12/2004 | Tan | B29C 66/1122 221/63 |
| 2004/0252920 | A1 * | 12/2004 | Moteki | B65B 61/18 383/200 |
| 2010/0290722 | A1 * | 11/2010 | DeSmedt | B65D 31/10 383/120 |
| 2011/0039676 | A1 * | 2/2011 | Totani | B31B 1/14 493/227 |
| 2011/0212815 | A1 * | 9/2011 | Totani | B65D 31/10 493/243 |
| 2012/0035036 | A1 * | 2/2012 | Pease | A44B 18/0046 493/264 |
| 2012/0201480 | A1 * | 8/2012 | Goto | B65B 9/20 383/42 |
| 2013/0203576 | A1 * | 8/2013 | Daughtry | B65D 33/02 493/189 |
| 2014/0209651 | A1 * | 7/2014 | Wilfong | A47F 13/085 225/93 |
| 2016/0229146 | A1 * | 8/2016 | Patel | B31B 37/00 |

FOREIGN PATENT DOCUMENTS

| | | |
|---|---|---|
| JP | 07-001617 | 1/1995 |
| JP | 2000-254984 | 9/2000 |
| JP | 2010-036585 | 2/2010 |
| JP | 2010-036586 | 2/2010 |
| JP | 2010-208332 | 9/2010 |
| JP | 2011-020719 | 2/2011 |
| JP | 2015-123620 | 7/2015 |
| WO | 2004009341 | 1/2004 |

OTHER PUBLICATIONS

International Search Report dated Aug. 12, 2016 in corresponding International patent application No. PCT/JP2016/067252.

* cited by examiner

APPARATUS AND METHOD FOR MAKING PLASTIC BAGS

TECHNICAL FIELD OF THE INVENTION

The invention relates to an apparatus and a method for successively making plastic bags.

BACKGROUND OF THE INVENTION

In an apparatus for successively making plastic bags, as described in Patent Document 1, webs of first and second panel materials are superposed on each other and fed longitudinally thereof. The plastic bags are made by the first and second panel materials, as also in the cases of apparatuses of Patent Documents 2 to 5.

In the case of the apparatus of Patent Document 1, the plastic bags include front, back and one end surfaces. A web of bottom gusset material is supplied to the web of the first or second panel material before the webs of the first and second panel materials are superposed on each other. Then, the front and back surfaces are formed by the webs of the first and second panel materials, while the one end surface is formed by the web of the bottom gusset material.

In this case, the apparatus should comprise a bottom gusset material supply device by which the web of the bottom gusset material is supplied from another supply roll in order to form the one end surface. The apparatus must therefore be complicated in structure and high in cost. When being printed with a pattern, a discrepancy in pattern between the panel and bottom gusset materials is also caused.

On the other hand, in the apparatus of Patent Document 2, a plastic film is slit along its longitudinal slit line so as to be divided into the webs of the first panel and bottom gusset materials before the webs of panel material are superposed on each other. The apparatus comprises a bottom gusset material guide device by which the web of the bottom gusset material is guided and supplied to the web of the first or second panel material. The front and back surfaces are formed by the webs of the first and second panel materials, while the one end surface is formed by the web of the bottom gusset material.

In the apparatus of Patent Document 3, the web of the bottom gusset material is supplied to the web of the first or second panel material and extended along its longitudinal centerline. Then, the web of the bottom gusset material is slit along its longitudinal centerline. The webs of the first and second panel materials are also slit along the longitudinal centerlines thereof before or after the web of the bottom gusset material is supplied. Thereby, the plastic bags are made two by two, each of which includes the front, back and one end surfaces. The front and back surfaces are formed by the webs of the first and second panel materials, while the one end surface is formed by the web of the bottom gusset material. The plastic bags are made two by two using the apparatus that can slit the plastic film along its longitudinal slit line so as to divide into the webs of the first panel and bottom gusset materials, as in the case of the apparatus of Patent Document 2.

In the case of the apparatuses of Patent Documents 2 and 3, the web of the bottom gusset material has therefore not been supplied from another supply roll because the plastic film can be supplied from its supply roll so as to be divided into the webs of the first panel and bottom gusset materials. As a result, the apparatus can be simple in structure and low in cost. When being printed with a pattern, a discrepancy in pattern between the panel and bottom gusset materials cannot be also caused.

By the way, another apparatus has also been proposed to successively make plastic bags using the bottom gusset material. In the case of the apparatus of Patent Document 4, for example, the plastic bags include the other end surfaces in addition to the front, back and one end surfaces. Two webs of the bottom gusset material are supplied to the web of the first or second panel material and extended along the opposite side portions thereof. The front and back surfaces are formed by the webs of the first and second panel materials. Among the two webs of the bottom gusset material, the one end surface is formed by one web of the bottom gusset material, while the other end surface is formed by the other web of the bottom gusset material. The plastic bags are made one by one using the apparatus.

In the case of the apparatus of Patent Document 4, a total of three webs of the bottom gusset material can be supplied. Among the three webs of the bottom gusset material, one particular web of the bottom gusset material has a width two times as much as a width of the two other webs of the bottom gusset material. The particular web of the bottom gusset material is supplied to the web of the first or second panel material and extended along its longitudinal centerline, while the other webs of the bottom gusset material are supplied to the web of the first or second panel material and extended along the opposite side portions thereof. The particular web of the bottom gusset material is slit along its longitudinal centerline after being supplied, as in the case of the bottom gusset material of Patent Document 3. The webs of the first and second panel materials are slit along the longitudinal centerline thereof before or after the webs of the bottom gusset material are supplied. The plastic bags are made two by two, each of which includes the front and back surfaces formed by the webs of the first and second panel material. The one end surface is formed by the particular web of the bottom gusset material, while the other end surface is formed by the other webs of the bottom gusset material. The apparatus can make the plastic bags two by two.

However, especially in the case of the apparatus by which the plastic bags are made two by two, a total of three webs of the bottom gusset material should be supplied to the web of the first or second panel material. Thus, in the case of the apparatus of Patent Document 2, even though the plastic film is divided into the webs of the first panel and bottom gusset materials, other webs of the bottom gusset material should be supplied from other supply rolls. The apparatus must therefore be complicated in structure and high in cost. When being printed with a pattern, a discrepancy in pattern between the panel and bottom gusset materials is also caused.

There is another apparatus by which the plastic bags are made two by two. In the apparatus, two webs of the bottom gusset material are supplied to the web of the first or second panel material and extended along the opposite side portions thereof. Then, the webs of the first and second panel materials are slit along the longitudinal centerline thereof. The plastic bags are therefore made two by two, each of which includes the front and back surfaces formed by the webs of the first and second panel material and the one end surface formed by the webs of the bottom gusset material.

However, the webs of the bottom gusset material should be supplied from other supply rolls. A discrepancy in pattern is also caused.

In the case of the apparatus of Patent Document 4, two webs of the bottom gusset material must be supplied to the web of the first or second panel material when making the plastic bags one by one. The webs of the bottom gusset material must therefore be supplied from other supply rolls, as also in the case of the apparatus described above. A discrepancy in pattern is also caused.

In the case of the apparatus of Patent Document 5, the web of the first or second panel material is guided by a panel material guiding device during the feed of the webs of the panel materials. The web of the first or second panel material is folded along its one side edge and folded back so as to form a folded portion. Therefore, the front and back surfaces are formed by the webs of the first and second panel materials, while the one end surface is formed by the folded portion.

Another apparatus by which the plastic bags are made two by two is also described in Patent Document 5. In the apparatus, the web of the first or second panel material is folded along its opposite side edges and folded back so as to form the folded portions. Then, the webs of the first and second panel materials are slit along the longitudinal centerline thereof. The plastic bags are therefore made two by two.

Therefore, in the apparatus, the web of the bottom gusset material is supplied to the web of the first or second panel material and extended along the longitudinal centerline thereof. Then, the web of the bottom gusset material is slit along its longitudinal centerline. The webs of the first and second panel material are also slit along the longitudinal centerline thereof before or after the web of the bottom gusset material is supplied. The plastic bags are made two by two, each of which includes the one end surface formed by the web of the bottom gusset material and the other end surface formed by the folded portions.

However, another bottom gusset material must be supplied from another supply roll. A discrepancy in pattern is also caused.

It is therefore an object of the invention to provide an apparatus for successively making the plastic bags, wherein the bottom gusset material should not be supplied from another supply roll and a discrepancy in pattern should not also be caused.

Patent Document 1: JP 4,436,521B
Patent Document 2: JP 4,469,412B
Patent Document 3: JP 4,429,379B
Patent Document 4: JP 4,526,592B
Patent Document 5: JP 3,655,627B

SUMMARY OF THE INVENTION

According to the invention, in an apparatus for successively making plastic bags each of which includes front, back and one end surfaces, the apparatus comprises a panel material feed device by which webs of first and second panel materials are superposed on each other and fed longitudinally thereof. The apparatus further comprises a first slit device by which a plastic film is slit along a longitudinal slit line so as to be divided into the web of the first panel material and a web of a bottom gusset material before the webs of the first and second panel materials are superposed on each other, the webs of the first and second panel materials being superposed on each other and fed longitudinally after divided. The apparatus further comprises a bottom gusset material feed device by which the web of the bottom gusset material after divided are fed longitudinally. The apparatus further comprises a second slit device by which the web of the bottom gusset material is further slit so as to be divided into a plurality of webs of the bottom gusset material. The apparatus further comprises a bottom gusset material guide device by which the webs of the bottom gusset material after slit are guided to the web of the first or second panel material. Thus, the plastic bags are made each time, each of which includes the front and back surfaces formed by the webs of the first and second panel materials and the one end surface formed by the web of the bottom gusset material.

In an apparatus for successively making plastic bags each of which includes front, back, one end and other end surfaces, the apparatus comprises a panel material feed device by which webs of first and second panel materials are superposed on each other and fed longitudinally thereof. The apparatus further comprises a first slit device by which a plastic film is slit along a longitudinal slit line so as to be divided into the web of the first panel material and a web of a bottom gusset material before the webs of the first and second panel materials are superposed on each other, the webs of the first and second panel materials being superposed on each other and fed longitudinally after divided. The apparatus further comprises a bottom gusset material feed device by which the web of the bottom gusset material after divided is fed longitudinally. The apparatus further comprises a second slit device by which the web of the bottom gusset material is further slit so as to be divided into three webs of the bottom gusset material. Thus, the three webs of the bottom gusset material are composed of one particular web and two other webs of the bottom gusset material. The particular web of the bottom gusset material has a width two times as much as a width of the other webs of the bottom gusset material. The particular web of the bottom gusset material is supplied to the web of the first or second panel material and extended along the longitudinal centerline thereof. The other webs of the bottom gusset material are supplied to the web of the first or second panel material and extended along the longitudinal centerline thereof. The particular web of the bottom gusset material after supplied is slit along the longitudinal centerline thereof. The webs of the first and second panel materials are slit along the longitudinal centerline thereof before or after the webs of the bottom gusset material are supplied. The plastic bags are made two by two each of which includes the front and back surfaces formed by the webs of the first and second panel materials, the one end surface formed by the particular web of the bottom gusset material and the other end surface formed by the other web of the bottom gusset material.

In the apparatus for making the plastic bags each of which includes opposite side surfaces in addition to the front, back, one end and other end surfaces, the apparatus further comprises a side gusset material supply device. Thus, a plurality of side gusset materials are supplied to the web of the first or second panel material and extend widthwise thereof before the webs of the first and second panel materials are superposed on each other. The side gusset materials are disposed between the webs of the first and second panel materials when the webs of the first and second materials are superposed on each other. The opposite side surfaces are formed by the side gusset materials.

The apparatus comprises a second slit device by which the web of the bottom gusset material is further slit so as to be divided into two webs of the bottom gusset material. Thus, each of the webs of the bottom gusset material are supplied to the web of the first or second panel materials and extended along opposite side edges thereof. The webs of the first and second panel materials are slit along its longitudinal centerline after the webs of the bottom gusset material are supplied. The plastic bags are made two by two each of which includes the front and back surfaces formed by the webs of the first and second panel materials and the one end surface formed by the web of the bottom gusset material.

The apparatus comprises a bottom gusset material guide device by which each of the webs of the bottom gusset material after slit is guided to the web of the first or second panel material and extended along opposite side edges thereof. Thus, the front and back surfaces are formed by the webs of the first and second panel materials, the one end surface being formed by one of the webs of the bottom gusset material, the other end surface being formed by the other of the webs of the bottom gusset material.

The apparatus comprises a slit device by which a plastic film is slit along a longitudinal slit line so as to be divided into the web of the first panel material and a web of a bottom gusset material before the webs of first and second panel materials are superposed on each other, the webs of the first and second panel materials being superposed on each other and fed longitudinally after divided. The apparatus further comprises a bottom gusset material feed device by which the web of the bottom gusset material after divided is fed longitudinally. The apparatus further comprises a bottom gusset material guide device by which the web of the bottom gusset material is guided so as to be supplied to the web of the first or second panel material and extended along the longitudinal centerline thereof. The apparatus further comprises a panel material guide device by which the web of the first or second panel material is guided during the feed of the webs of the first and second panel materials and folded along opposite side edges thereof and folded back so as to form a folded portion. Thus, the web of the bottom gusset material after supplied is slit along longitudinal centerline thereof. The webs of the first and second panel materials are slit along longitudinal centerline thereof before or after the web of the bottom gusset material is supplied. The plastic bags are made two by two each of which includes the front and back surfaces formed by the webs of the first and second panel materials, the one end surface formed by the webs of the bottom gusset material and the other end surface formed by the folded portion.

The bottom gusset material feed device is composed of a roller. The apparatus further comprises a dancer roller adjacent to an upstream of the bottom gusset material feed device so that an amount of the feed of the web of the bottom gusset material can be absorbed by the dancer roller.

DETAILED EXPLANATION OF THE PREFERRED EMBODIMENTS

Embodiments of the invention are as follows.

Figure 1A:
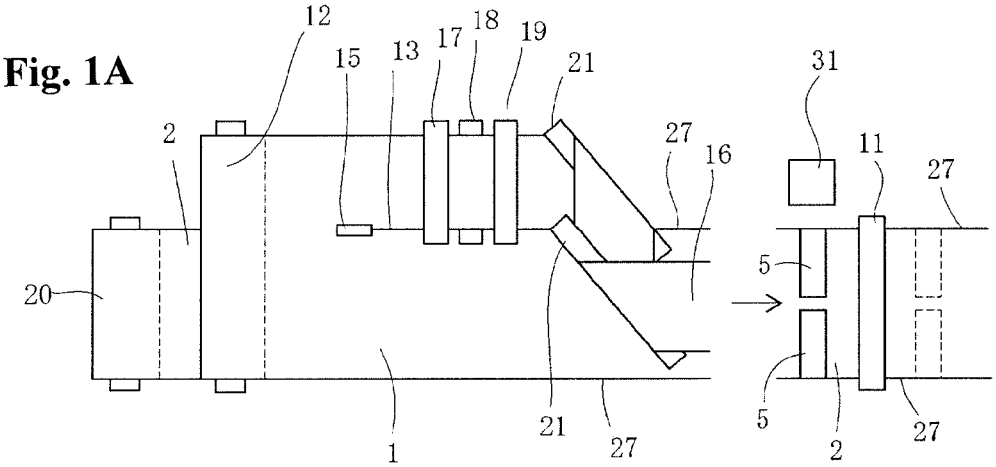
FIG. 1A is a plan view of a preferred embodiment of the invention.
Figure 1B:
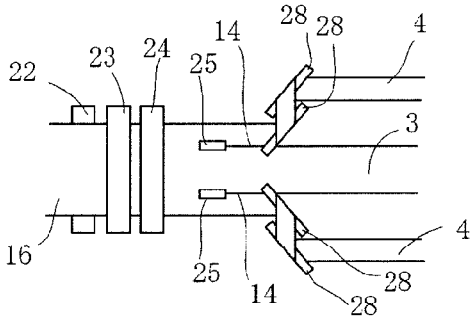
FIG. 1B is a plan view wherein a wide web of a bottom gusset material shown in FIG. 1A is being slit.
Figure 1D:
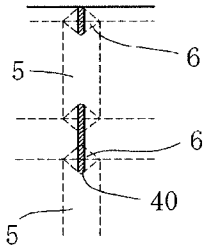
FIG. 1D is an explanatory view showing another embodiment.
Figure 1C:
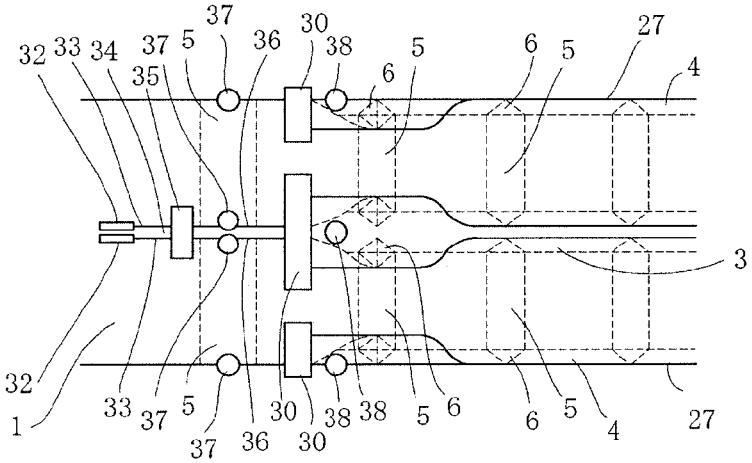
FIG. 1C is a plan view wherein a web of a first panel material shown in FIG. 1A is being folded.
Figure 2A:
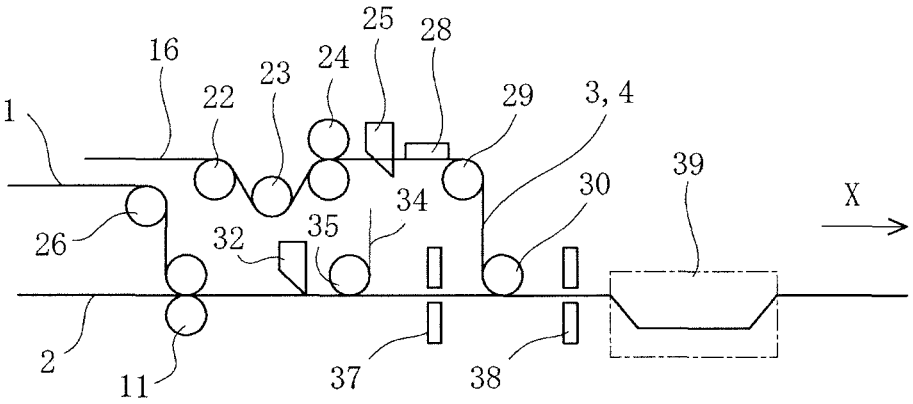
FIG. 2A is a side view of the apparatus shown in FIG. 1.
Figure 2B:
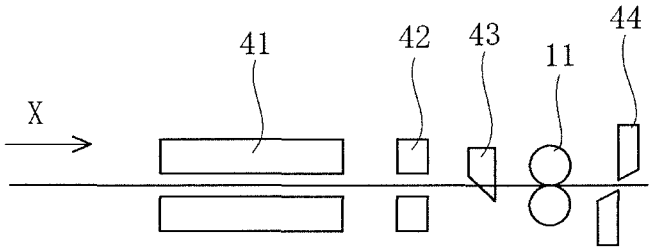
FIG. 2B is a side view of a longitudinal seal device, a cross seal device and a cutter of an apparatus of FIG. 2A.

Turning now to the drawings, FIGS. 1 and 2 illustrates an apparatus for successively making plastic bags. The apparatus is used in order to make the plastic bag shown in FIG. 3. The plastic bag of FIG. 3 includes front, back and one end surfaces, as also in the case of the plastic bag of Patent Document 1. The front and back surfaces are made from first and second panel materials 1 and 2, while the one end surface is made from a bottom gusset material 3. The plastic bag includes the other end surface and opposite side surfaces in addition to the front, back and one end surfaces, as also in the case of the plastic bag of Patent Document 4. The other surface is made from a bottom gusset material 4. The opposite side surfaces are made from side gusset materials 5. The side gusset materials 5 have opposite end portions by which auxiliary gusset portions 6 are formed. One end edge 7, the other end edge 8 and opposite side edges 9 are formed by the first and second panel materials 1 and 2. The panel materials 1 and 2 and the side gusset materials 5 are heat sealed along the opposite side edges 9. The auxiliary gusset portions 6 and the bottom gusset materials 3 and 4 are heat sealed along the opposite side edges 9. As a result, its heat seal lines 10 are formed along the opposite side edges 9, as also in the case of the plastic bag of Patent Document 4. In addition, the panel materials 1 and 2 and the bottom gusset material 3 are heat sealed along the one end edge 7 so that its heat seal line 10 are formed along the one end edge 7. The panel materials 1 and 2 and the bottom gusset material 4 are heat sealed along the other end edge 8 so that its heat seal line 10 are formed along the other end edge 8.

Figure 3A:
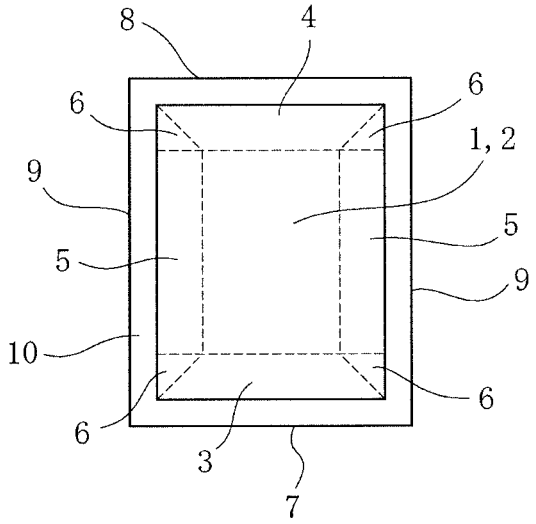
FIG. 3A is a plan view of a plastic bag made by the apparatus shown in FIG. 1.
Figure 3B:
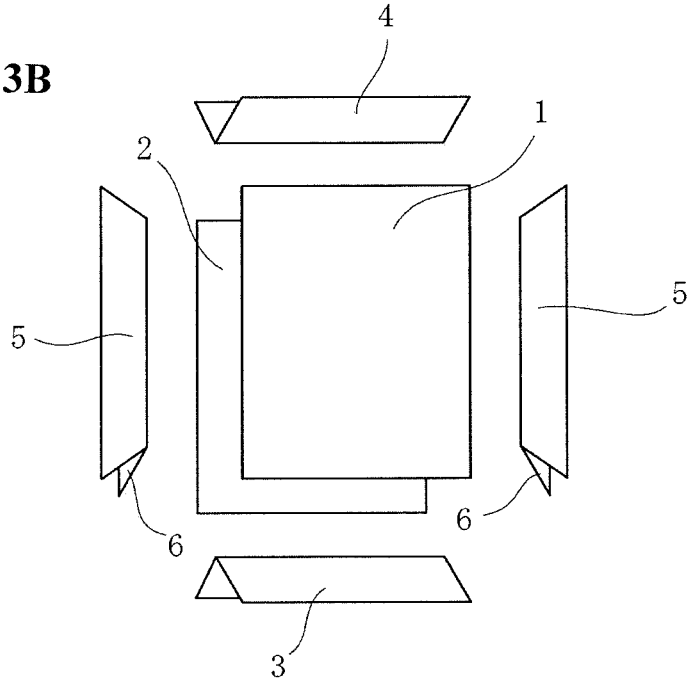
FIG. 3B is an explosive view of the plastic bag shown in FIG. 3A.

In order to successively make the plastic bags shown in FIG. 3, the apparatus shown in FIGS. 1 and 2 comprises a panel material feed device by which webs of the first and second panel materials 1 and 2 are superposed on each other and fed longitudinally thereof. The panel material feed device comprises feed rollers 11. The webs of first and second panel materials 1 and 2 are directed to the feed rollers 11. The feed rollers 11 are driven and rotated by a drive motor so that the webs of the first and second panel materials 1 and 2 are fed longitudinally thereof. The feed rollers 11 are rotated intermittently so that the webs of the first and second panel materials 1 and 2 are fed in a direction X intermittently.

In the apparatus, a plastic film is supplied from a supply roll 12 and directed to a slit device before the webs of the first and second panel materials 1 and 2 are superposed on each other. The plastic film is slit along a plurality of longitudinal slit lines 13 and 14 so as to be divided into the web of the first panel material 1 and a plurality of webs of the bottom gusset material 3 and 4. In the embodiment, the plastic film is slit along the three longitudinal slit lines 13 and 14 so as to be divided into the web of the first panel material 1 and the three webs of the bottom gusset material 3 and 4.

For example, the slit device comprises a plastic film slit blade 15. The plastic film is directed to the slit blade 15 so as to be slit during the feed of the plastic film. At first, the plastic film is slit along its longitudinal slit line 13 so as to be divided into the web of the first panel material 1 and a wide web of a bottom gusset material 16. The plastic film is printed in a predetermined pattern successively. The wide web of the bottom gusset material 16 is directed to a bottom gusset material guide device so as to be guided. For example, the bottom gusset material guide device comprises guide rollers 17, 18 and 19. The wide web of the bottom gusset material 16 is passed through the guide roller 17, then directed to the guide roller 18 so as to be elevated, and then directed to the guide roller 19 so as to be lowered. Thus, the position of the printed pattern is adjusted. The guide roller 18 can be composed of a dancer roller.

On the other hand, the web of the second panel material 2 is also made from another plastic film supplied from its supply roller 20. The web of the second panel material 12 is directed to the lower side of the web of the first panel material 1 and extended longitudinally. Thus, the web of the first panel material 1 is disposed on the upper side of the apparatus, while the web of the second panel material 2 is disposed on the lower side thereof. The bottom gusset material guide device comprises turn bars or turn rollers 21. The turn bars or the turn rollers 21 guide and turn the wide web of the bottom gusset material 16. As a result, the wide web of the bottom gusset material 16 is directed to the upper side of the web of the first panel material 1 and extended longitudinally.

The bottom gusset material guide device comprises a guide roller 22. The wide web of the bottom gusset material 16 above the web of the first panel material 1 is passed through the guide roller 22, then directed to a dancer roller 23 so as to be lowered, and then directed to feed rollers 24 so as to be elevated. The feed rollers 24 are driven and rotated by a drive motor so that the wide web of the bottom gusset material 16 is fed longitudinally thereof. The feed rollers 24 are rotated intermittently so that the wide web of the bottom gusset material 16 is fed intermittently, as also in the cases of the webs of the first and second panel materials 1 and 2. The slit device further comprises two slit blades 25. The wide web of the bottom gusset material 16 is directed to the slit blades 25 so as to be slit during the feed of the bottom gusset material 16. Thus, the wide web of the bottom gusset material 16 is slit along two longitudinal slit lines 14 so as to be divided into three webs of the bottom gusset material 3 and 4.

In the apparatus, the plastic film is slit along the longitudinal slit line 13 by the first slit device so as to be divided into the web of the first panel material 1 and the web of the bottom gusset material 16 before the webs of the first and second panel materials 1 and 2 are superposed on each other. The first slit device comprises the slit blade 15. After divided, the webs of the first and second panel materials 1 and 2 are superposed on each other and fed longitudinally thereof. The wide web of the bottom gusset material 16 after slit is fed longitudinally by a bottom gusset material feed device. Then, the wide web of the bottom gusset material 16 is slit and divided into a plurality of webs of the bottom gusset material 3 and 4 by a second slit device. And then, the slit webs of the bottom gusset material 3 and 4 are guided and supplied to the webs of the first and second panel materials 1 and 2 by the bottom gusset material guide device. The bottom gusset material feed device is composed of the feed rollers 24. The second slit device is composed of the slit blades 25.

In the apparatus, the bottom gusset material feed device comprises the feed rollers 24. The slit web of the bottom gusset material 16 is fed longitudinally thereof by the bottom gusset material feed device. It may be problematic in the plastic bag making process that the web of the bottom material 16 usually narrower than the panel materials 1 and 2 may be sagged, swung or torn in some cases if not fed longitudinally thereof. Thus, the apparatus comprises the bottom gusset material feed device by which the slit web of the bottom gusset material 16 can be fed longitudinally so as not to be sagged, swung and torn in order to make the plastic bags certainly.

In the apparatus, the plastic film is directed to the slit device and slit along the three longitudinal slit lines 13 and 14 so as to be divided into the web of the first panel material 1 and the three webs of the bottom gusset material 3 and 4. The slit device comprises the three slit blades 15 and 25. Each of the slit blades 15 and 25 is spaced from each other widthwise of the plastic film. The plastic film is slit and divided by the slit blades 15 and 25 during the feed of the plastic film.

After divided, the web of the first panel material 1 is guided by and passed through the guide roller 26 so as to be directed and lowered to the feed rollers 11. The web of the second panel material 2 is also directed to the feed rollers 11. Thus, the webs of the first and second panel materials 1 and 2 are superposed on each other and fed longitudinally thereof.

The wide web of the bottom gusset material 16 in addition to the webs of the first and second panel materials 1 and 2 are fed intermittently by the intermittent rotation of the feed rollers 11 and 24, while the plastic film is fed continuously from the supply roll 12. Thus, after slit, the wide web of the bottom gusset material 16 in addition to the web of the first panel material 1 are fed continuously. The web of the second panel material 2 is fed continuously from the supply roll 20. The wide web of the bottom gusset material 16 is directed to the dancer roller 23 and the feed rollers 24 so as to be fed intermittently by the intermittent rotation of the feed rollers 24. Thus, a difference in the amount of the feed thereof is caused. However, the difference can be absorbed by the dancer roller 23 which can be elevated and lowered by the tension of the wide web of the bottom gusset material 16.

This point is the same as the cases of the first and second panel materials 1 and 2. The webs of the first and second panel materials 1 and 2 are fed to dancer rollers (not shown) which can be elevated and lowered by its tension so that a difference in the amount of the feed thereof can be absorbed by the dance rollers.

In the apparatus, the plastic film is divided into the web of the first panel material 1 and the three webs of the bottom gusset material 3 and 4. Then, the three webs of the bottom gusset material 3 and 4 are guided and supplied to the web of the first or second panel material 1 or 2 by the bottom gusset material guide device. The three divided webs of the bottom gusset material 3 and 4 are composed of one particular web of the bottom gusset material 3 and the other webs of the bottom gusset material 4. The particular web of the bottom gusset material 3 has a width two times as much as the other webs of the bottom gusset material 4. The particular web of the bottom gusset material 3 is supplied to the web of the first or second panel material 1 or 2 and extended along its longitudinal centerline. The other webs of the bottom gusset material 4 are supplied to the web of the first or second panel material 1 or 2 and extended along its opposite side edges 27.

The bottom gusset material guide device for example comprises turn bars or turn rollers 28 by which the other webs of the bottom gusset materials 4 are directed and turned. The other webs of the bottom gusset materials 4 are away from the particular web of the bottom gusset material 3 widthwise thereof then the other webs of the bottom gusset materials 4 are parallel to the particular web of the bottom gusset material 3 adjacent to the opposite sides of the particular web of the bottom gusset material 3. The bottom gusset material guide device further comprises bottom gusset guide rollers 29 and 30. The webs of the bottom gusset material 3 and 4 are passed through the guide rollers 29 and directed to the guide rollers 30. Then, the particular web of the bottom gusset material 3 is supplied to the web of the first or second panel material 1 or 2 and extended along the longitudinal centerline thereof, while the other webs of the bottom gusset materials 4 are supplied to the web of the first or second panel material 1 or 2 and extended along opposite side edges 27 thereof. In the embodiment, as also in the case of the apparatus of Patent Document 3, after the webs of the first and second panel materials 1 and 2 are superposed on each other, the particular web of the bottom gusset material 3 is supplied to the web of the first panel material 1, then extended along its longitudinal centerline, and then superposed on its outer surface. The other webs of the bottom gusset material 4 are supplied to the web of the first panel material 1, then extended along the opposite side edges 27, and then superposed on its outer surfaces.

Furthermore, as also in the case of the apparatus of Patent Document 3, before the webs of the first and second panel materials 1 and 2 are superposed on each other, the side gusset materials 5 are folded into halves and supplied to the web of the first or second panel material 1 or 2 whenever being fed intermittently. For example, the side gusset materials 5 are fold into halves and supplied by a side gusset material supply device 31. The side gusset material supply device 31 comprises a side gusset materials supply robot by which the side gusset materials 5 are divided into two longitudinally thereof so that the divided side gusset materials 5 are supplied. In the embodiment, the side gusset materials 5 are supplied to the web of the second panel material 2 and extended widthwise thereof, then the webs of the first and second panel materials 1 and 2 are superposed on each other so that the side gusset materials 5 are disposed between the webs of the first and second panel materials 1 and 2.

Further, in the apparatus, after the webs of the bottom gusset material 3 and 4 are supplied to the web of the first panel material 1, the particular web of the bottom gusset material 3 is slit along its longitudinal centerline. Furthermore, the webs of the first and second panel materials 1 and 2 are also slit along the longitudinal centerline thereof before or after the webs of the bottom gusset materials 3 and 4 are supplied to it.

For example, as also in the case of the apparatus of Patent Document 3, after the webs of the first and second panel materials 1 and 2 are superposed on each other, the web of the first panel material 1 is supplied to a slit device so as to be slit along its longitudinal centerline and divided widthwise thereof. In the embodiment, the slit device comprises two slit blades 32 which are spaced from each other widthwise of the web of the first panel material 1. The web of the first panel material 1 is slit by the slit blades 32 during the feed of the first panel material 1. The web of the first panel material 1 is slit along two longitudinal centerlines 33 thereof so that a waste 34 is made. The waste 34 is passed through a guide roller 35 and collected upwardly. Thus, divided side edges 36 of the webs of the first panel material 1 are formed. The side gusset materials 5 are divided into two, as described previously. Opposite side edges of each of the side gusset materials 5 are temporarily fixed to the webs of the second panel material 2 in addition to the first panel material 1. For example, temporarily fix devices 37 comprise heat seal devices or ultrasonic seal devices by which the webs of the first and second panel materials 1 and 2 and the side gusset materials 5 are ultrasonic sealed with and temporarily fixed to each other. The fixed points are disposed on a longitudinal centerline of the side gusset material 5.

Then, the webs of the bottom gusset material 3 and 4 are directed to the guide rollers 30 so as to be supplied to the webs of the first panel material 1, then extended along the longitudinal centerline and the opposite side edges 27 thereof, and then superposed on the outer surface thereof. Further, as also in the case of the apparatus of Patent Document 3, after the webs of the bottom gusset materials 3 and 4 are supplied, the particular web of the bottom gusset material 3 are temporarily fixed to the web of the second panel material 2 between the divided side edges 33 of the webs of the first panel material 1. Furthermore, the other webs of the bottom gusset material 4 are temporarily fixed to the web of the second panel material 2 adjacent to the opposite side edges 27 of each of the webs of the first panel material 1. For example, temporarily fix devices 38 comprise heat seal devices or ultrasonic seal devices by which the particular web of the bottom gusset material 3, the other webs of the bottom gusset material 4 and the web of the second panel material 2 are heat sealed or ultrasonic sealed with and temporarily fixed to each other.

Then, as also in the case of the apparatus of Patent Document 3, the webs of the first and second panel materials 1 and 2 are directed to a panel material guide device 39 by which the webs of the first and second panel materials 1 and 2 are guided so that the webs of the first panel material 1 are folded along longitudinal fold lines thereof adjacent to the divided side edges 36 of the webs of the first panel material 1, and then unfolded. Further, the webs of the first panel material 1 are folded along longitudinal fold lines thereof adjacent to the opposite side edges 27 of each of the webs of the first panel material 1, and then unfolded. The panel material guide device 39 comprises guide rods or guide plates, as also in the case of the device of Patent Document 3. The webs of the first panel material 1 are folded and unfolded by the guide rods or the guide plates. The side gusset materials 5 are opened and closed by the webs of the first panel material 1 adjacent to the divided side edges 36 of the webs of the first panel material 1 so as to form the auxiliary gusset portions 6. The particular web of the bottom gusset material 3 is folded into two by the webs of the first panel material 1, then combined with the auxiliary gusset portions 6, and then disposed between the webs of the first and second panel materials 1 and 2. At the same time, the side gusset materials 5 are opened and closed by the webs of the first panel material 1 adjacent to the opposite side edges 27 of each of the webs of the first panel material 1 so as to form the auxiliary gusset portions 6. The other webs of the bottom gusset material 4 is folded into two by the webs of the first panel material 1, then combined with the auxiliary gusset portions 6, and then disposed between the webs of the first and second panel materials 1 and 2.

In another embodiment, as shown in FIG. 1D, when the webs of the first panel material 1 are folded along the longitudinal fold lines thereof and the side gusset materials 5 are opened by the webs of the first panel material 1, each of the webs of the bottom gusset materials 3 and 4 and the auxiliary gusset portions 6 are heat sealed or ultrasonic sealed with each other so that their temporarily fixed portions 40 can be formed.

Then, the webs of the first and second panel materials 1 and 2 are directed to a longitudinal seal device 41 and a cross seal device 42. The webs of the first and second panel materials 1 and 2 and the particular web of the bottom gusset material 3 are heat sealed with each other by the longitudinal seal device 41, while the webs of the first and second panel materials 1 and 2 and the other webs of the bottom gusset material 4 are heat sealed with each other by the longitudinal seal device 41 whenever the webs of the first and second panel materials 1 and 2 are fed intermittently. The webs of the first and second panel materials 1 and 2 and the particular web of the bottom gusset material 3 are heat sealed along the longitudinal centerline of the webs of the first and second panel materials 1 and 2, while the webs of the first and second panel materials 1 and 2 and the other webs of the bottom gusset material 4 are heat sealed along the opposite side edges 27 of each of the webs of the first and second panel materials 1 and 2. Further, the webs of the first and second panel materials 1 and 2 and the side gusset materials 5 are heat sealed with each other widthwise thereof by the cross seal device 42 whenever the webs of the first and second panel materials 1 and 2 are fed intermittently. The webs of the first and second panel materials 1 and 2 and the side gusset material 5 are heat sealed with each other along the longitudinal centerline of the side gusset material 5.

It is noted that the webs of the first and second panel materials 1 and 2 and the particular web of the bottom gusset material 3 are not heat sealed by the longitudinal seal device 41. That is to say, the web of one of the panel materials and the particular web of the bottom gusset material 3 are heat sealed with each other, while the web of the other of panel materials and the particular web of the bottom gusset material 3 are not heat sealed. After making the plastic bag, the plastic bag is filled with content which is passed between the other panel material and the particular bottom gusset material 3. Then, the other panel material and the particular bottom gusset material 3 can be heat sealed with each other. In the same way, the webs of the first and second panel materials 1 and 2 and the web of the other of the bottom gusset materials 4 are not heat sealed by the longitudinal seal device 41. That is to say, the web of one of the panel materials and the web of the other of the bottom gusset materials 4 are heat sealed with each other, while the web of the other panel material and the web of the other of the bottom gusset material 4 are not heat sealed. After making the plastic bag, the plastic bag is filled with content which is passed between the other panel material and the other bottom gusset material 4. Then, the other panel material and the other bottom gusset material 4 can be heat sealed with each other.

And then, the webs of the first and second panel materials 1 and 2 are directed to the slit device so that the particular web of the bottom gusset material 3 is slit along its longitudinal centerline and the web of the second panel material 2 is also slit along its longitudinal centerline. For example, the slit device comprises bottom and panel slit blades 43 by which the particular web of the bottom gusset material 3 and the web of the second panel material 2 are slit during the feed of the webs of the first and second panel materials 1 and 2. The web of the first panel material 1 has already been slit, as described previously.

The slit device may comprise the two slit blades 43 which are spaced from each other widthwise of the webs of the first and second panel materials 1 and 2 with a gap whose width is wider than that of the gap of the slit blades 32. Moreover, the web of the first panel material 1 in addition to the particular web of the bottom gusset material 3 and the web of the second panel material 2 can be slit by the slit blades 43.

And then, the webs of the first and second panel materials 1 and 2 are directed to a cutter 44 by which the webs of the first and second panel materials 1 and 2, the particular web of the bottom gusset material 3, the other web of the bottom gusset material 4 and the side gusset materials 5 are cross cut widthwise thereof whenever being fed intermittently. The webs of the first and second panel materials 1 and 2, the particular web of the bottom gusset material 3, the other web of the bottom gusset material 4 and the side gusset materials 5 are cross cut along the longitudinal centerline of the side gusset material 5.

The plastic bags are therefore made two by two, each of which includes the front and back surfaces formed by the first and second panel material 1 and 2, one end surface formed by the particular bottom gusset material 3 and the other end surface formed by the other bottom gusset material 4. Further, the opposite side surfaces are formed by the side gusset materials 5.

Therefore, in the apparatus, the plastic bags are made two by two, each of which includes one end surface formed by the particular bottom gusset material 3 and the other end surface formed by the other bottom gusset material 4. The three webs of the bottom gusset material 3 and 4 should be supplied to the web of the first or second panel material 1 or 2. However, in the apparatus, the plastic film are slit along three longitudinal slit lines 13 and 14 so as to be divided into the web of the first panel material 1 and the three webs of the bottom gusset material 3 and 4. Each of the webs of the bottom gusset material 3 and 4 can be supplied to the web of the first or second panel material 1 or 2 after divided so that the apparatus has not to comprise a bottom gusset material supply device by which the web of the bottom gusset material is supplied from another supply roll. The apparatus can therefore be simple in structure and low in cost. When being printed with a pattern, a discrepancy in pattern between the panel materials 1 and 2 and the bottom gusset materials 3 and 4 should not also be caused.

As described previously, the apparatus comprises the bottom gusset material feed device by which the slit web of the bottom gusset material 16 is fed longitudinally so as not to be sagged, swung and torn in order to make the plastic bags certainly.

It is not always necessary that the first panel material 1 should be disposed on the upper side of the apparatus and the second panel material 2 should be disposed on the lower side thereof when the first and second panel materials 1 and 2 are superposed on each other. Contrary to the embodiment in which the first panel material 1 can be disposed on the lower side of the apparatus and the second panel material 2 can be disposed on the upper side thereof.

Figure 4A:
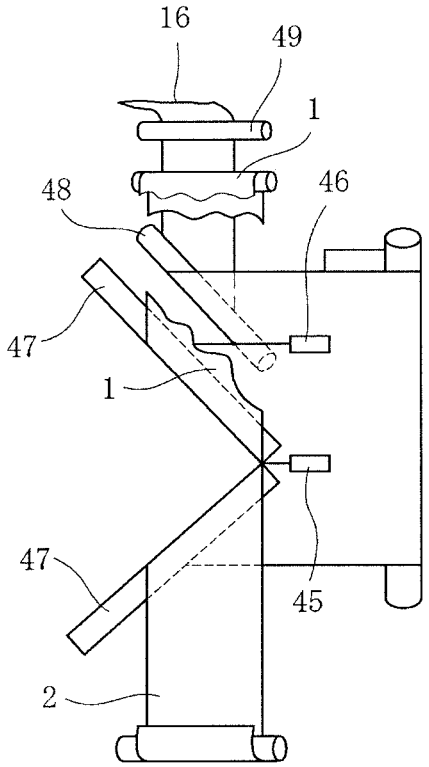
FIG. 4A is an explanatory view of another embodiment.

It is not always necessary to supply the web of the second panel material 2 from the supply roll 20 different from the supply roll 12 for the first panel material 1. As shown in FIG. 4, the following another embodiment will be described, as also in the case of the apparatus of Patent Document 2. As shown in FIG. 4A, the plastic film is supplied from its supply roll and slit by a slit blade 45 so as to be divided into the webs of the first and second panel materials 1 and 2. The plastic film is also slit by a slit blade 46 so as to be divided into the web of the first panel material 1 and the wide web of the bottom gusset material 16. The webs of the first and second panel materials 1 and 2 are guided and turned by guide plates 47, then they 1 and 2 are superposed and fed longitudinally thereof. Further, the wide web of the bottom gusset material 16 is guided and turned by a turn bar or a turn roller 48 and a guide roller 49. And then, the wide web of the bottom gusset material 16 is slit by the slit blades into the three webs of the bottom gusset material 3 and 4 which are supplied to the web of the first or second panel material 1 or 2, as also in the case of the embodiment of FIG. 1.

In the case, the plastic film is slit along the longitudinal slit line so as to be divided into the webs of the first and second panel materials 1 and 2. Further, the plastic film is slit along the three longitudinal slit lines so as to be divided into the web of the first panel material 1 and the three webs of the bottom gusset material 3 and 4. The four slit blades are used in order to slit the plastic film. The plastic film can be slit along each of the longitudinal slit lines at the same time.

Figure 4B:
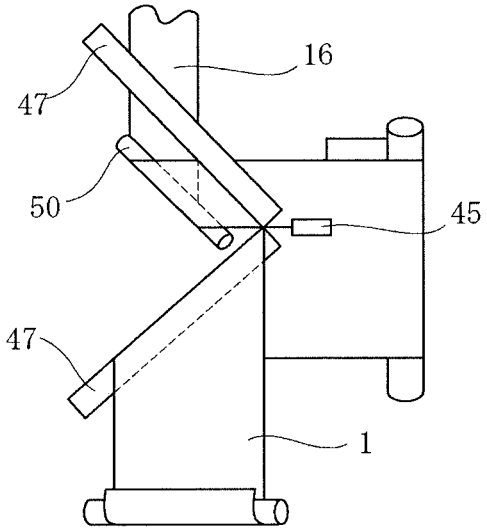
FIG. 4B is an explanatory view of another embodiment.

As shown in FIG. 4B, the plastic film is supplied from its supply roll and slit by the slit blade 45 so as to be divided into the web of the first panel material 1 and the wide web of the bottom gusset material 16. The web of the first panel material 1 is guided and turned by a guide plate 47. The web of the second panel material 2 is further supplied from its supply roll, as also in the case of the embodiment of FIG. 1. Then, the webs of the first and second panel materials 1 and 2 are superposed and fed longitudinally. Moreover, the wide web of the bottom gusset material 16 is guided and turned by a turn bar or a turn roller 50, then the web 16 is divided into the three webs of the bottom gusset material 3 and 4.

Figure 5A:
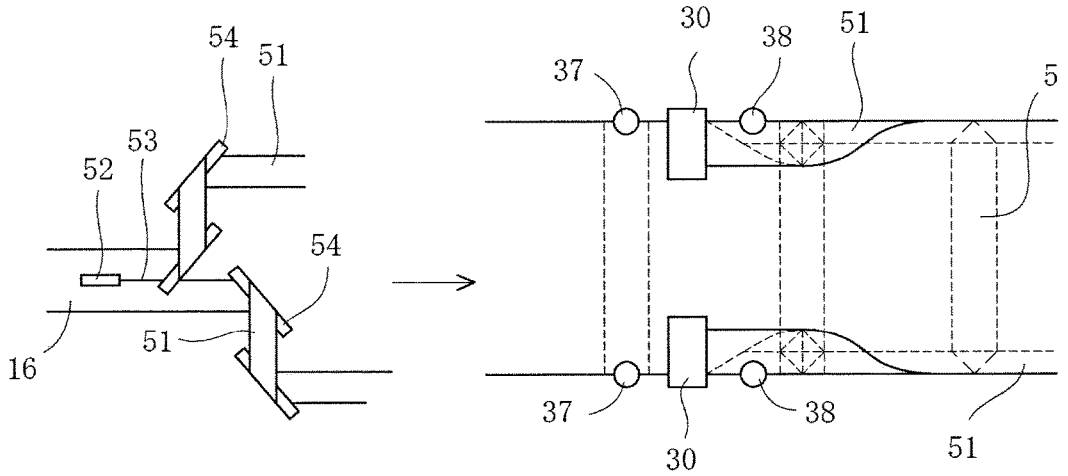
FIG. 5A is a plan view of another embodiment.
Figure 5B:
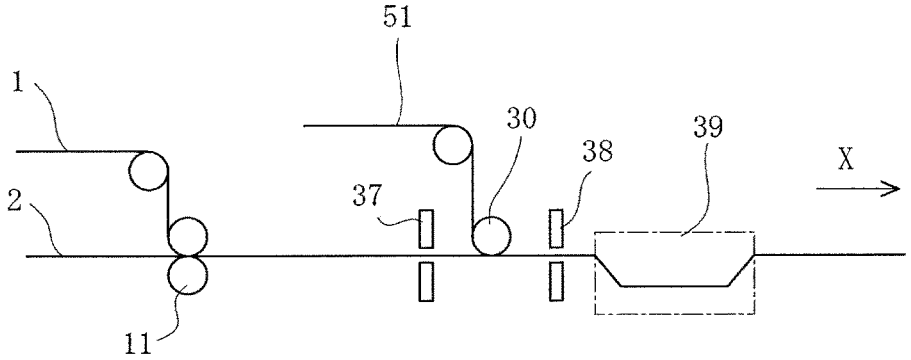
FIG. 5B is a side view of the apparatus shown in FIG. 5A.
Figure 5C:
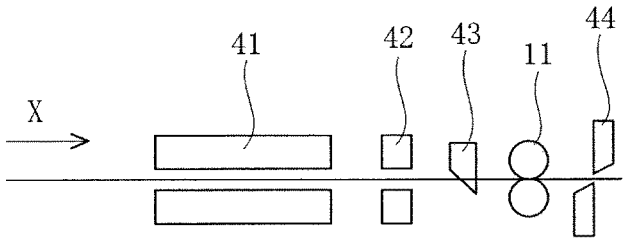
FIG. 5C is a side view of a longitudinal seal device, a cross seal device and a cutter of the apparatus of FIG. 5B.
Figure 6A:
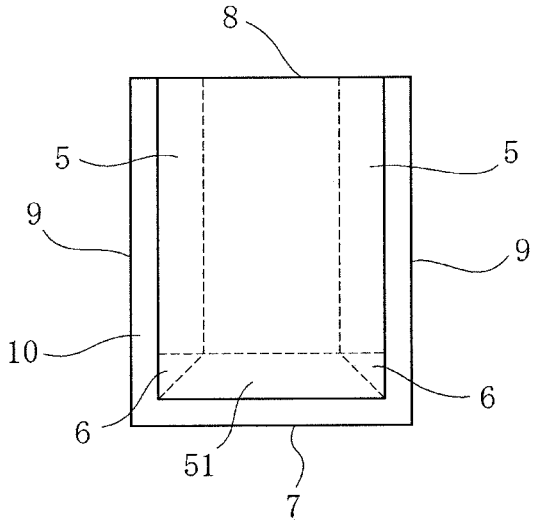
FIG. 6A is a plan view of a plastic bag made by the apparatus shown in FIG. 5.
Figure 6B:
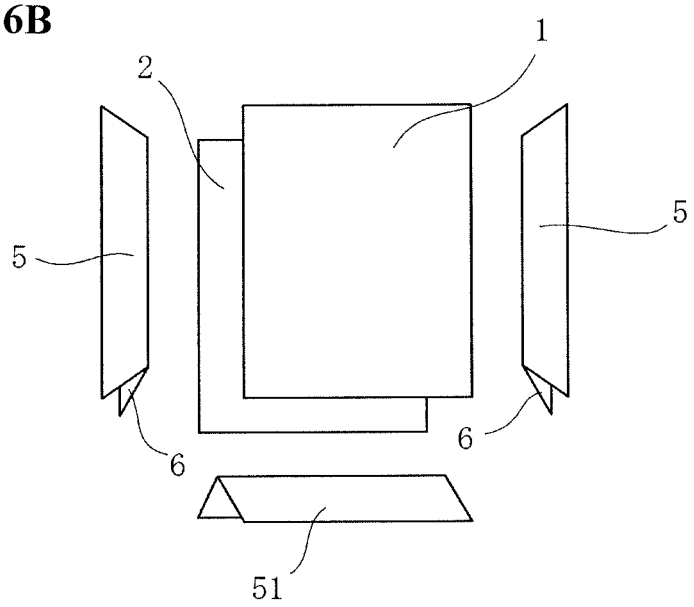
FIG. 6B is an explosive view of the plastic bag shown in FIG. 6A.

As shown in FIG. 5, the following another embodiment will be described. The apparatus is used in order to make the plastic bag shown in FIG. 6. The plastic bag shown in FIG. 6 includes the front, back and one end surfaces. The front and back surfaces are made from the first and second panel materials 1 and 2, while the one end surface is made from the bottom gusset material 51. The plastic bag further includes the opposite side surfaces which are made from the side gusset materials 5. The auxiliary gusset portion 6 is formed at one end portion of the side gusset material 5. The first and second panel materials 1 and 2 and the side gusset materials 5 are heat sealed with each other along the opposite side edges 9, while the auxiliary gusset portions 6 and the bottom gusset material 51 are heat sealed with each other along the opposite side edges 9, so that its heat seal lines 10 are formed along the opposite side edges 9. The first and second panel materials 1 and 2 and the bottom gusset material 51 are further heat sealed with each other along the one end edge 7 so that the heat seal line 10 is formed along the one end edge 7.

In the apparatus shown in FIG. 5 also, the webs of the first and second panel materials 1 and 2 are superposed on each other and fed longitudinally. The panel material feed device comprises the feed rollers 11 by which the webs of the first and second panel materials 1 and 2 are fed intermittently, as also in the case of the apparatus shown in FIG. 1.

In the apparatus shown in FIG. 5 also, before the webs of the panel materials 1 and 2 are superposed on each other, the plastic film is supplied from its supply roll 12 and directed to the slit blade 15 so as to be slit along its longitudinal slit line 13 and divided into the web of the first panel material 1 and the wide web of the bottom gusset material 16, as also in the case of the apparatus shown in FIG. 1. Then, the wide web of the bottom gusset material 16 is directed to a slit blade 52 so as to be slit along its longitudinal slit line 53 and divided into the two webs of the bottom gusset material 51. That is to say, the plastic film is slit along two longitudinal slit lines 13 and 53 so as to be divided into the web of the first panel material 1 and the two webs of the bottom gusset material 51.

Therefore, in the apparatus shown in FIG. 5 also, the plastic film is slit along its longitudinal slit line 13 by the first slit device so as to be divided into the web of the first panel material 1 and the web of the bottom gusset material 16, then the web of the bottom gusset material 16 is slit into the webs of the bottom gusset material 51 by the second slit device. The first slit device comprises the slit blade 15, while the second device comprises the slit blade 52. The plastic film may be slit along each of the longitudinal slit lines 13 and 53 at the same time.

After divided, the webs of the first and second panel materials 1 and 2 are directed to the feed rollers 11 so as to be superposed and fed. The bottom material guide device comprises turn bars or turn rollers 54 by which each of the webs of the bottom gusset material 51 are guided and turned. Then, each of the webs of the bottom gusset material 51 is supplied to the web of the first or second panel material 1 or 2 and extended along the opposite end edges thereof. In the embodiment, as also in the case of the bottom gusset material 4 shown in FIG. 1, each of the webs of the bottom gusset material 51 is directed to the guide roller 30 so as to be supplied to the web of the first panel material 1, extended its opposite side edges and superposed on its outer surface.

Before the webs of the panel materials 1 and 2 are superposed, the side gusset materials 5 are supplied by the side gusset material supply device and extended widthwise of the panel materials 1 and 2. However, in the embodiment, the side gusset material 5 is not divided into two. The webs of the first and second panel materials 1 and 2 and the side gusset materials 5 are temporarily fixed to the opposite end portions of each of the side gusset materials 5 by the temporarily fix devices 37, as also in the case of the apparatus shown in FIG. 1.

The supplied webs of the bottom gusset material 51 and the web of the second panel material 2 are temporarily fixed adjacent to the opposite side edges of the first panel material 1 by the temporarily fix device 38, as also in the case of the apparatus shown in FIG. 1. Then, the web of the first panel material 1 is folded and unfolded adjacent to the opposite side edges of the first panel material 1 by the bottom gusset material guide device 39. The side gusset materials 5 are opened and closed by the web of the first panel material 1 so that the auxiliary gusset portions 6 are formed. Each of the webs of the bottom gusset material 51 is folded into two and combined with the auxiliary gusset portions 6.

Then, the webs of the first and second panel materials 1 and 2 are directed to the longitudinal seal device 41 and the cross seal device 42. Whenever the first and second panel materials 1 and 2 are fed intermittently, the webs of the first and second panel materials 1 and 2 and the webs of the bottom gusset material 51 are heat sealed with each other longitudinally thereof by the longitudinal seal device 41, while the webs of the first and second panel materials 1 and 2 and the side gusset materials 5 are heat sealed with each other widthwise thereof by the cross seal device 42.

Then, the webs of the first and second panel materials 1 and 2 and the side gusset materials 5 are slit by the slit blade 43 during the feed of the first and second panel materials 1 and 2. The webs of the first and second panel materials 1 and 2 and the side gusset materials 5 are slit along the longitudinal centerline of the webs of the first and second panel materials 1 and 2. And then, the webs of the first and second panel materials 1 and 2, the webs of the bottom gusset material 51 and the side gusset materials 5 are cross cut widthwise thereof by the cutter 44 whenever the first and second panel materials 1 and 2 are fed intermittently. The webs of the first and second panel materials 1 and 2, the webs of the bottom gusset material 51 and the side gusset materials 5 are cross cut along the longitudinal centerline of the side gusset material 5.

The plastic bags are therefore made two by two, each of which includes the front and back surfaces formed by the first and second panel materials 1 and 2 and one end surface formed by the bottom gusset material 51. Further, the opposite side surfaces are formed by the side gusset materials 5.

In the case of the apparatus shown in FIG. 5, the two webs of the bottom gusset material 51 should be supplied to the web of the first or second panel material 1 or 2. However, the plastic film are slit along two longitudinal slit lines 13 and 53 so as to be divided into the web of the first panel material 1 and the two webs of the bottom gusset material 51. Each of the webs of the bottom gusset material 51 can be supplied to the web of the first or second panel material 1 or 2 after divided so that the apparatus has not to supply the web of the bottom gusset material from another supply roll. The apparatus can therefore be simple in structure and low in cost. When being printed with a pattern, a discrepancy in pattern between the panel materials 1 and 2 and the bottom gusset material 51 should not also be caused.

Figure 7A:
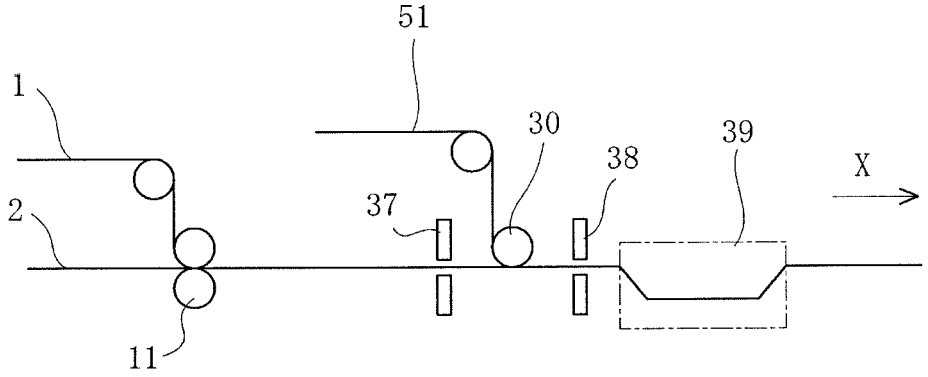
FIG. 7A is a side view of another embodiment.
Figure 7B:
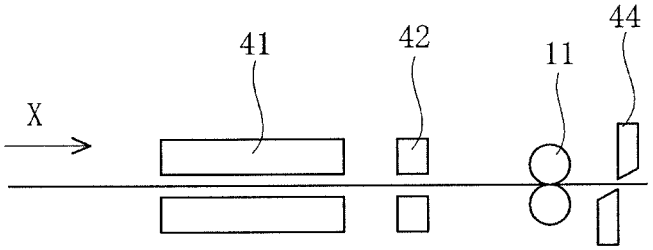
FIG. 7B is a side view of a longitudinal seal device, a cross seal device and a cutter of the apparatus of FIG. 7A.
Figure 8A:
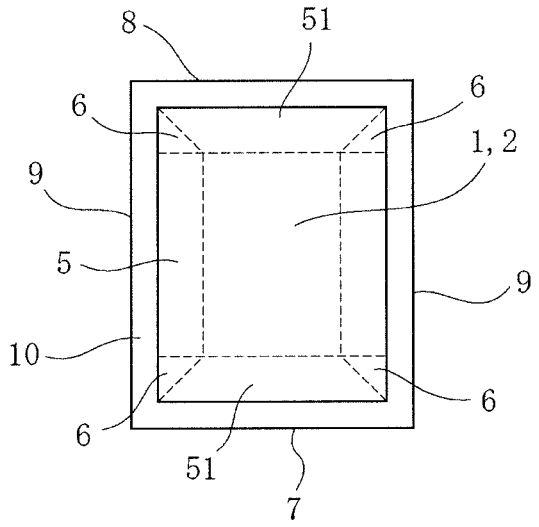
FIG. 8A is a plan view of a plastic bag made by the apparatus shown in FIG. 7.
Figure 8B:
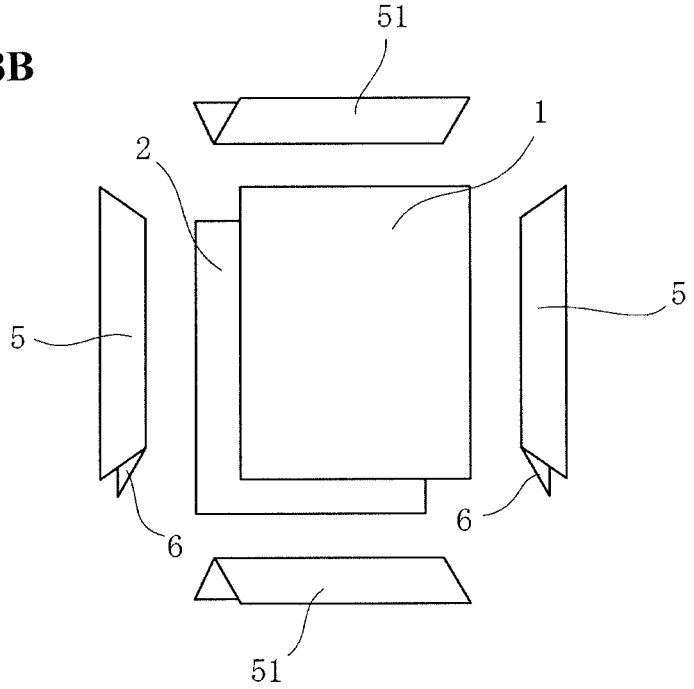
FIG. 8B is an explosive view of the plastic bag shown in FIG. 8A.

The apparatus shown in FIG. 7 is used in order to make the plastic bag shown in FIG. 8.

The apparatus shown in FIG. 7 is the same as the apparatus shown in FIG. 5 in structure, which comprises the slit blades 15 and 52. Thus, the plastic film is slit along the two longitudinal slit lines 13 and 53 so as to be divided into the web of the first panel material 1 and the two webs of the bottom gusset material 51. Then, the two webs of the bottom gusset material 51 are supplied to the web of the first or second panel material 1 or 2 and extended along the opposite side edges thereof. The webs of the first and second panel materials 1 and 2, the webs of the bottom gusset material 51 and the side gusset materials 5 are heat sealed with each other by the longitudinal seal device 41 and the cross seal device 42, as also in the case of the apparatus shown in FIG. 5.

However, the apparatus shown in FIG. 7 does not comprise the slit blade 43 so that the webs of the first and second panel materials 1 and 2 and the side gusset materials 5 cannot be slit. The webs of the first and second panel materials 1 and 2, the webs of the bottom gusset material 51 and the side gusset materials 5 are cut by the cutter 44.

Thus, the plastic bags are therefore made one by one, each of which includes the front and back surfaces formed by the first and second panel materials 1 and 2, one end surface formed by one of the bottom gusset material 51 and the other end surface formed by the other of the bottom gusset material 51. Further, the opposite side surfaces are formed by the side gusset materials 5.

The apparatus shown in FIG. 7 also has not to supply the two webs of the bottom gusset material 51 from another supply roll. The apparatus can therefore be simple in structure and low in cost, and a discrepancy in pattern should not also be caused.

Figure 11A:
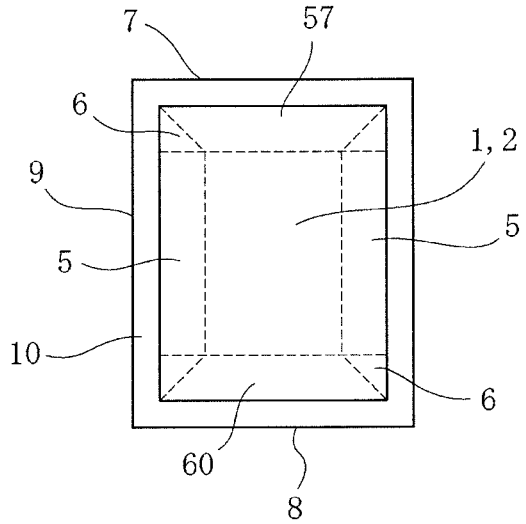
FIG. 11A is a plan view of a plastic bag made by the apparatus shown in FIG. 9.
Figure 11B:
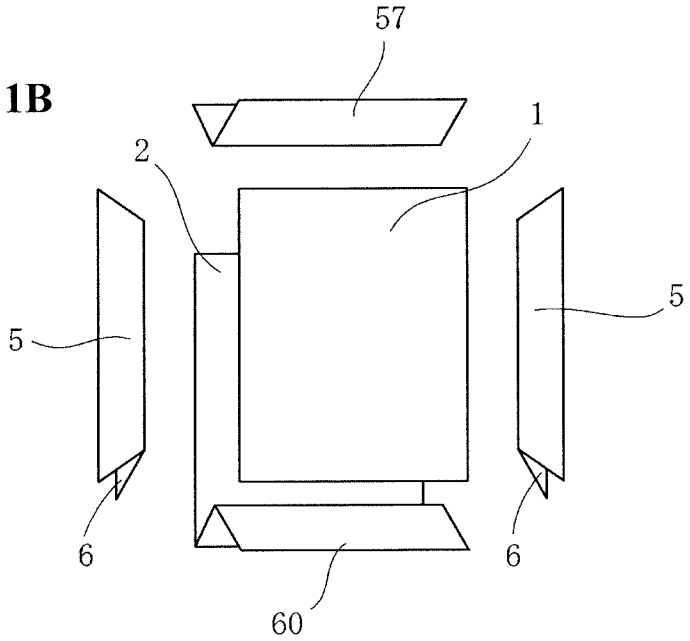
FIG. 11B is an explosive view of the plastic bag shown in FIG. 11A.

The apparatus shown in FIG. 9 is used in order to make the plastic bag shown in FIG. 11.

Figure 9A:
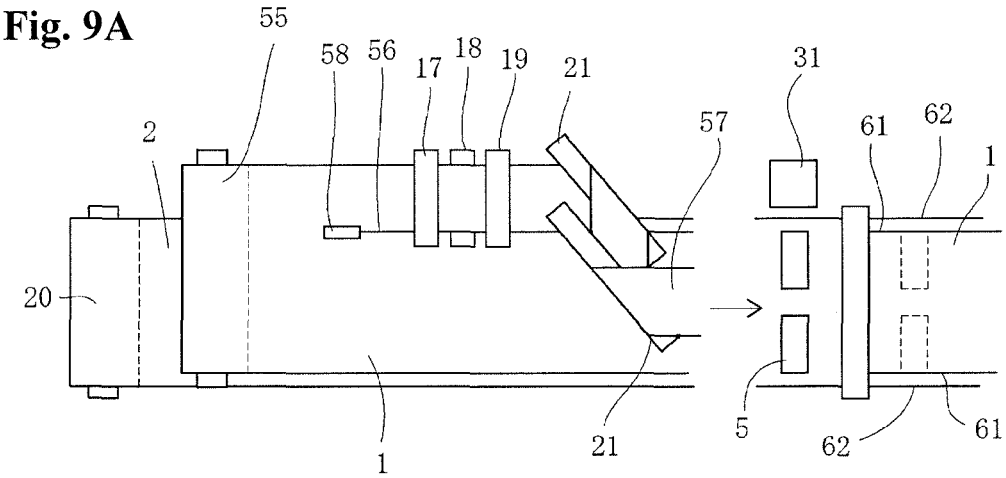
FIG. 9A is a plan view of another embodiment.
Figure 9B:
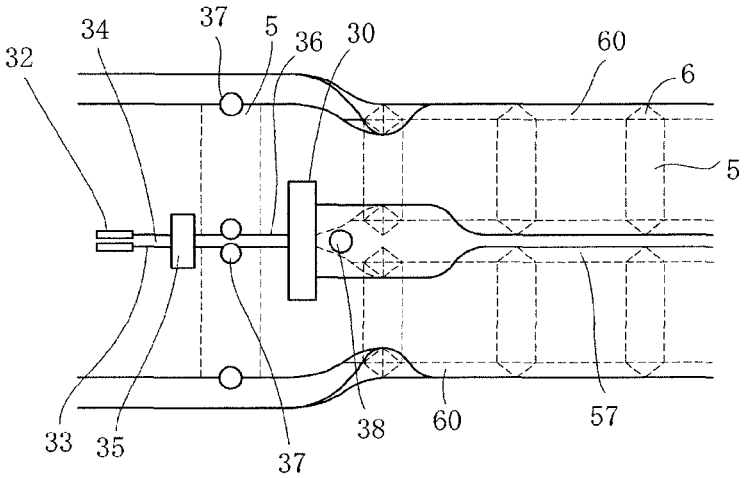
FIG. 9B is a plan view wherein webs of first and second panel materials are being folded.
Figure 9C:
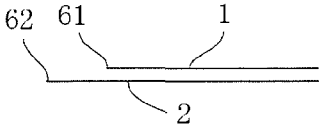
FIG. 9C is a cross sectional view showing the webs of the first and second panel materials of FIG. 9B.
Figure 9D:
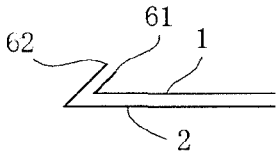
FIG. 9D is a cross sectional view showing the webs of the first and second panel materials of FIG. 9C folded.
Figure 9E:
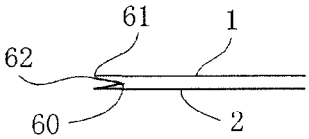
FIG. 9E is a cross sectional view showing the web of the first panel material unfolded and the web of the second panel material folded back.
Figure 10A:
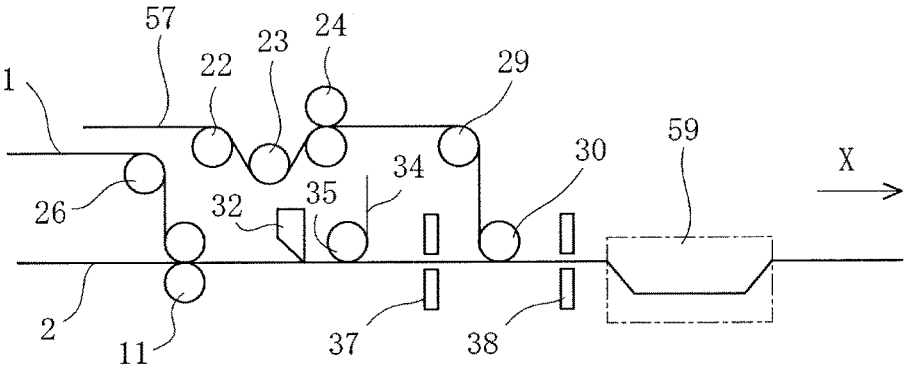
FIG. 10A is a side view of the apparatus shown in FIG. 9.
Figure 10B:
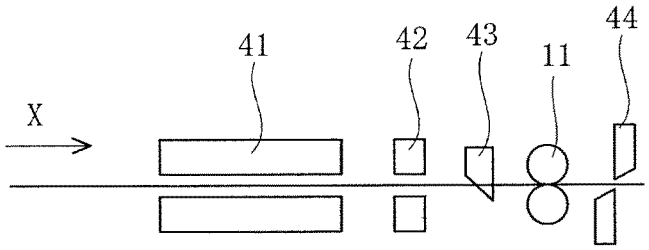
FIG. 10B is a side view of a longitudinal seal device, a cross seal device and a cutter of the apparatus of FIG. 10A.

In the apparatus of FIG. 9 also, as shown in FIG. 10, the webs of the first and second panel materials 1 and 2 are superposed on each other and fed longitudinally. The panel material feed device comprises the feed rollers 11 by which the webs of the first and second panel materials 1 and 2 are fed intermittently.

In the apparatus, before the webs of the panel materials 1 and 2 are superposed, the plastic film is supplied from its supply roll 55 and directed to the slit device so as to be slit along its longitudinal slit line 56 and divided into the web of the first panel material 1 and the web of the bottom gusset material 57. The slit device is composed of a slit blade 58. The web of the second panel material 2 is supplied from its supply roll 20, then the webs of the first and second panel materials 1 and 2 are directed to the feed rollers 11 so as to be superposed and fed longitudinally thereof, as also in the case of the apparatus shown in FIG. 1.

The web of the bottom gusset material 57 is guided by the bottom gusset material guide device so as to be supplied to the webs of the first and second panel materials 1 and 2 and extended along its longitudinal centerline. The web of the bottom gusset material 57 is directed to the guide rollers 17, 18 and 19 by which the position of the printed pattern can be adjusted, as also in the case of the bottom gusset material 16 shown in FIG. 1. The web of the bottom gusset material 57 is guided and turned by the turn bars or the turn rollers 21 so as to be directed to the upper side of the first panel material 1. The web of the bottom gusset material 57 is directed to the guide roller 22, the dancer roller 23 and the feed rollers 24 so as to be fed by the feed rollers 24. The web of the bottom gusset material 57 is fed intermittently. The difference in the amount of the feed thereof can be absorbed by the dance roller 23. Then, the web of the bottom gusset material 57 is directed to the guide rollers 29 and 30 so as to be supplied to the web of the first panel material 1 and extended along its longitudinal centerline.

The side gusset materials 5 are supplied by the side gusset material supply device 31, as also in the case of the apparatus shown in FIG. 1. The side gusset materials 5 are divided into two. The web of the first panel material 1 is slit by the slit blades 32 so that the waste 34 is passed through the guide roller 35 and collected upwardly, as also in the case of the apparatus shown in FIG. 1. Thus, the divided side edges 36 of each of the webs of the first panel material 1 are formed. The webs of the first and second panel materials 1 and 2 and the side gusset materials 5 are temporarily fixed to each other by the temporarily fix devices 37, as also in the case of the apparatus shown in FIG. 1. Furthermore, the web of the bottom gusset material 57 is supplied to the web of the first panel material 1 and temporarily fixed to the web of the second panel material 2 by the temporarily fix device 38.

Then, the webs of the first and second panel materials 1 and 2 are directed to the panel materials guide device 59 by which the webs of the first and second panel materials 1 and 2 are guided so that the webs of the first panel material 1 are folded along longitudinal fold lines thereof adjacent to the divided side edges 36 of the webs of the first panel material 1, and then unfolded. Therefore, the side gusset materials 5 are opened and closed by the webs of the first panel material 1 so as to form the auxiliary gusset portions 6. The web of the bottom gusset material 57 is folded into two by the webs of the first panel material 1 and combined with the auxiliary gusset portions 6 so as to be disposed between the webs of the first and second panel materials 1 and 2, as also in the case of the apparatus shown in FIG. 1.

At the same time, in the apparatus, the webs of the first and second panel materials 1 and 2 is directed by the panel material guide device 59 so that the web of the first or second panel material 1 or 2 is folded and folded back so as to form folded portions 60. The web of the first panel material 1 has a width and its opposite side edges 61. The web of the second panel material 2 has a width wider than that which the first panel material 1 has. Thus, as shown in FIG. 9C, the web of the second panel material 2 is superposed on the web of the first panel material 1 to have opposite side edges 62 protruding beyond the opposite side edges 61 of the web of the first panel material 1 at a distance. Then, the webs of the first and second panel materials 1 and 2 are folded along the opposite side edges 61 and 61 respectively, as shown in FIG. 9D. And then, as shown in FIG. 9E, the web of the second panel material 2 is folded back along its opposite side edges 62, while the web of the first panel material 1 is unfolded. As a result, the folded portions 60 are formed. Therefore, the side gusset materials 5 are opened and closed by the webs of the first and second panel materials 1 and 2 so as to form the auxiliary gusset portions 6 which are combined with the folded portions 60. The panel material guide device 59 is the same as that of Patent Document 5.

Then, as also in the case of the apparatus shown in FIG. 1, whenever the webs of the first and second panel materials 1 and 2 are fed intermittently, the webs of the first and second panel materials 1 and 2 and the web of the bottom gusset material 57 are heat sealed with each other longitudinally thereof by the longitudinal seal device 41. Further, the first panel materials 1 and the folded portions 60 are heat sealed with each other by the longitudinal seal device 41. The webs of the first and second panel materials 1 and 2 and the web of the bottom gusset material 57 are heat sealed with each other along the longitudinal centerline thereof. The webs of the first panel material 1 and the folded portions 60 are heat sealed with each other along the opposite side edges 61 and 62 of each of the first and second panel materials 1 and 2. It should be noted that the webs of the first and second panel materials 1 and 2 and the folded portions 60 can be heat sealed with each other along the opposite side edges 61 and 62 of each of the first and second panel materials 1 and 2.

The webs of the first and second panel materials 1 and 2 and the web of the bottom gusset material 57 are not heat sealed by the longitudinal seal device 41. That is to say, one of the panel materials and the bottom gusset material 57 are heat sealed with each other. After making the plastic bag, the plastic bag is filled with content which is passed between the other of the panel materials and the bottom gusset material 57. Then, the other of the panel materials and the bottom gusset material 57 may be heat sealed with each other. The webs of the first panel material 1 and the folded portions 60 are not heat sealed by the longitudinal seal device 41. After making the plastic bag, the plastic bag is filled with content which is passed between the first panel material 1 and the folded portion 60. Then, the first panel material 1 and the folded portion 60 may be heat sealed with each other.

Further, the webs of the first and second panel materials 1 and 2 and the side gusset materials 5 are heat sealed with each other by the cross seal device 42. The webs of first and second panel materials 1 and 2 and the side gusset materials 5 are heat sealed with each other along the longitudinal centerline of the side gusset material 5. Then, the bottom gusset material 57 and the second panel material 3 are slit by the silt blades 43 during the feed of the webs of the first and second panel materials 1 and 2. The webs of the bottom gusset material 57 and the second panel material 2 are slit along the longitudinal centerline thereof. The web of the first panel material 1 has already been slit, as described previously. Then, the webs of the first and second panel materials 1 and 2, the web of the bottom gusset material 57 and the side gusset materials 5 are cross cut by the cutter 47.

The plastic bags are therefore made two by two, each of which includes the front and back surfaces formed by the first and second panel material 1 and 2, one end surface formed by the bottom gusset material 57 and the other end surface formed by the folded portion 60. Further, the opposite side surfaces are formed by the side gusset materials 5.

In the apparatus also, the web of the bottom gusset material has therefore not to be supplied from another supply roll. The discrepancy in pattern cannot be also caused.

DESCRIPTION OF THE REFERENCE CHARACTERS

1 first panel material
2 second panel material
3, 4, 51, 57 bottom gusset material
11 feed roller
13, 14, 53, 56 longitudinal slit line
15, 25, 46, 52, 58 slit blade
39, 59 panel material guide device
21, 28, 54 bottom material guide device
60 folded portion

What is claimed is:

1. An apparatus for successively making plastic bags each of which includes front, back, one end and other end surfaces, the apparatus comprising:

a panel material feed device configured to superpose a web of a first panel material on a web of a second panel material and then feed the webs of the first and second panel materials longitudinally thereof;

a first slit device configured to slit a plastic film along a longitudinal slit line so as to divide the plastic film into the web of the first panel material and a wide web of a bottom gusset material before the webs of first and second panel materials are superposed on each other, the webs of the first and second panel materials being superposed on each other and fed longitudinally after divided;

a bottom gusset material feed device configured to feed the wide web of the bottom gusset material longitudinally after divided;

a second slit device configured to further slit the wide web of the bottom gusset material so as to divide the wide web of the bottom gusset material into three webs of the bottom gusset material; and a bottom gusset material guide device configured to guide and supply the three webs of the bottom gusset material to the web of the first or second panel material, the bottom gusset material guide device being disposed on a downstream side of the second slit device; wherein the three webs of the bottom gusset material is composed of one particular web of the bottom gusset material and two other webs of the bottom gusset material, the particular web of the bottom gusset material having a width two times as much as a width of the other webs of the bottom gusset material, the particular web of the bottom gusset material being supplied to the web of the first or second panel material and extended along longitudinal centerline thereof, the other webs of the bottom gusset material being supplied to the web of the first or second panel material and extend along opposite side edges thereof, the particular web of the bottom gusset material being slit along longitudinal centerline thereof after supplied, the webs of the first and second panel materials being also slit along the longitudinal centerline thereof before or after the particular and the other webs of the bottom gusset material are supplied, and the plastic bags being made two by two each of which includes the front and back surfaces formed by the webs of the first and second panel materials, the one end surface formed by the particular web of the bottom gusset material and the other end surface formed by the other web of the bottom gusset material.

2. The apparatus as set forth in claim 1 wherein each of the plastic bags includes opposite side surfaces in addition to the front, back, one end and other end surfaces, the apparatus further comprising:

a side gusset material supply device configured to supply a plurality of side gusset materials to the web of the first or second panel material, the side gusset materials being extended widthwise of the web of the first or second panel material before the webs of the first and second panel materials are superposed on each other, the side gusset materials being disposed between the webs of the first and second panel materials when the webs of the first and second materials are superposed on each other; and wherein the opposite side surfaces are formed by the side gusset materials.

3. A method for successively making plastic bags each of which includes front, back, one end and other end surfaces, the method comprising the steps of:

superposing webs of first and second panel materials on each other and feeding the webs of the first and second panel materials longitudinally thereof by a panel material feed device;

slitting a plastic film along a longitudinal slit line by a first slit device so as to divide into the web of the first panel material and a wide web of a bottom gusset material before the webs of first and second panel materials are superposed on each other, the webs of the first and second panel materials being superposed on each other and fed longitudinally after divided;

feeding the wide web of the bottom gusset material longitudinally by a bottom gusset material feed device after divided;

further slitting the wide web of the bottom gusset material so as to divide into three webs of the bottom gusset material by a second slit device;

guiding and supplying the three webs of the bottom gusset material to the web of the first or second panel material by a bottom gusset material guide device, the bottom gusset material guide device being disposed on a downstream side of the second slit device; wherein the three webs of the bottom gusset material is composed of one particular web of the bottom gusset material and two other webs of the bottom gusset material, the particular web of the bottom gusset material having a width two times as much as a width of the other webs of the bottom gusset material, the particular web of the bottom gusset material being supplied to the web of the first or second panel material and extended along longitudinal centerline thereof, the other webs of the bottom gusset material being supplied to the web of the first or second panel material and extend along opposite side edges thereof, the particular web of the bottom gusset material being slit along longitudinal centerline thereof after supplied, the webs of the first and second panel materials being also slit along the longitudinal centerline thereof before or after the particular and the other webs of the bottom gusset material are supplied, and the plastic bags being made two by two each of which includes the front and back surfaces formed by the webs of the first and second panel materials, the one end surface formed by the particular web of the bottom gusset material and the other end surface formed by the other web of the bottom gusset material.

4. The method as set forth in claim 3 wherein each of the plastic bags includes opposite side surfaces in addition to the front, back, one end and other end surfaces, the method further comprising the step of:

supplying a plurality of side gusset materials to the web of the first or second panel material and extending the web of the first or second panel material widthwise thereof by a side gusset material supply device before the webs of the first and second panel materials are superposed on each other, the side gusset materials being disposed between the webs of the first and second panel materials when the webs of the first and second materials are superposed on each other; and wherein the opposite side surfaces are formed by the side gusset materials.

* * * * *